United States Patent [19]

Baba

[11] 4,265,364

[45] May 5, 1981

[54] BOTTLE CAP

[75] Inventor: Isamu Baba, Ikoma, Japan

[73] Assignee: Zenyu Kinzoku Co., Ltd., Osaka, Japan

[21] Appl. No.: 67,186

[22] Filed: Aug. 16, 1979

[30] Foreign Application Priority Data

Aug. 25, 1978 [JP] Japan ..... 53-117173[U]

[51] Int. Cl.[3] ..... B65D 41/42

[52] U.S. Cl. ..... 215/249

[58] Field of Search ..... 215/249, 251, 253, 250

[56] References Cited

U.S. PATENT DOCUMENTS

| | | | |
|---|---|---|---|
| 3,193,128 | 7/1965 | Ravn | 215/249 X |
| 3,358,865 | 12/1967 | Andersen | 215/249 |
| 3,587,897 | 6/1971 | Rohde | 215/249 |
| 3,904,059 | 9/1975 | Bellamy | 215/249 X |

*Primary Examiner*—Donald F. Norton

*Attorney, Agent, or Firm*—Darby & Darby

[57] ABSTRACT

The present application discloses a bottle cap for a medicine bottle, such as a small bottle or vial or the like, in which the cap main body and a removable member made of the same metallic material are securely fixed to each other by cold pressure welding while forming therein pressed concave portions in an annular shape. Said cap main body and said removable member are provided within said pressed concave portions in the annular shape thereof with upwardly expanded portions. Thus, the present invention provides a good air-tight cap which is easy to be manufactured and which can be heat-sterilized.

8 Claims, 6 Drawing Figures

BOTTLE CAP

BACKGROUND OF THE INVENTION

Generally a vial is used in such a way that a rubber stopper press-fitted to the vial neck is covered with a cap, a predetermined portion of the cap is then removed, and an injection needle is passed through such removed portion.

In a conventional cap, a through-bore has been formed in the top plate of the cap main body made of metallic material and a resinous removable member has been attached on this through-bore of the top plate. When intending to open the cap, this removable member is raised up to break the attached portions thereof. With such arrangement, however, the attached portions may not be provided with good airtightness and it is not possible to heat-sterilize the cap with the removable portion remained as attached to the cap main body, since the removable member is made of resin. Accordingly, such cap has not sealingly been fitted in the aseptic condition to the rubber stopper and subsequently the rubber stopper portion through which an injection needle is passed, has not been covered in the aseptic condition. This has required a sterilization method other than heat-sterilization, so that complicated and therefore expensive sterilizing equipment has been necessary. Moreover, since such conventional cap 'comprises a metallic cap main body and a resinous removable member, complicated manufacturing equipment has also been required.

OBJECTS OF THE INVENTION

It is an object of the present invention to provide a bottle cap in which, by merely pushing up the periphery of the removable member with the thumb of the hand holding a bottle, a predetermined portion of the top plate of the cap main body may be broken, so that the removable member may be removed with one hand, thereby to facilitate the cap opening procedures to a great extent.

It is another object of the present invention to provide a bottle cap in which the cap main body and the removable member may be formed by stamping and securely fixed to each other by cold pressure welding, thereby to provide good airtightness to prevent the entrance of bacteria, as well as to facilitate the manufacturing of such cap.

It is a further object of the present invention to provide a bottle cap in which the cap main body and the removable member are made of the same metallic material such as aluminium, thereby to facilitate fixing of the cap main body to the removable member by the cold pressure welding and to permit such cap to be heat-sterilized just before sealingly fitted to a vial after having been delivered from factory, whereby such cap may sealingly be fitted in the aseptic condition to a rubber stopper, thereby to simplify cap sterilizing equipment and to facilitate sterilizing procedures.

It is still another object of the present invention to provide a bottle cap in which upwardly expanded portions are formed within the inside of the pressed concave portions in the annular shape formed in the removable member and the cap main body, thereby to easily absorb expansion of the rubber stopper due to the internal pressure in a vial.

It is a still further object of the present invention to provide a bottle cap in which pressed concave portions in the annular shape formed by cold pressure welding for securely fixing the top plate of the cap main body and the base plate of the removable member to each other, are formed thin so that, when opening the cap, the annular pressed concave portion of the top plate of the cap main body is easily broken to facilitate the opening procedure.

It is a still further object of the present invention to provide a bottle cap in which annular scores are formed in the under surface of the pressed concave portion of the top plate of the cap main body, thereby to permit the cap to be easily opened with a small and constant opening force, and such scores may be formed simultaneously with forming the pressed concave portions for fixing the cap main body top plate to the removable plate, thereby to facilitate the manufacturing of such cap.

It is a still further object of the present invention to provide a bottle cap in which an annular projection is formed at the under surface of the top plate of the cap main body at the outside of the annular pressed concave portion thereof so as to be press-contacted to the upper surface of a rubber stopper press-fitted to the bottle neck, whereby the top plate of the cap main body perfectly come in close contact with the rubber stopper, thereby to prevent the entrance of foreign matter such as bacteria or dust into the pressed concave portions from the clearance between the rubber stopper and the top plate.

It is a still further object of the present invention to provide a bottle cap in which a rolled-in ring is formed at the periphery of the removable member, thereby to reinforce the periphery of the removable member, simultaneously with forming a contact member to which the finger is applied when intending to remove such removable member, thereby to facilitate the removing operation.

BRIEF DESCRIPTION OF THE DRAWINGS

The present invention will be further described by way of example, with reference to the accompanying drawings, in which.

DETAILED DESCRIPTION OF THE PREFERRED EMBODIMENTS

Figure 1:
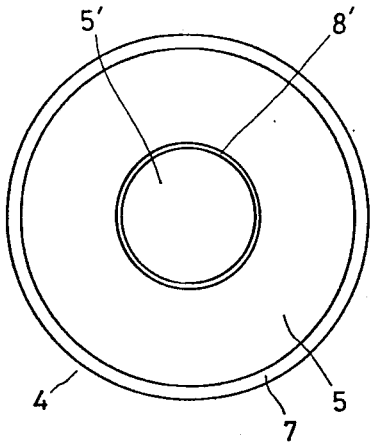
FIG. 1 is a plan view of a first embodiment of a bottle cap according to the present invention.

The description will first be made of a first embodiment of a bottle cap according to the present invention, with reference to FIGS. 1 and 2.

A cap main body 1 made of metallic material such as aluminium has a top plate 2. A side wall 3 is formed by downwardly turning the periphery of the top plate 2. A removable member 4 is made of the same metallic material, such as aluminium, as material of the cap main body 1. This removable member 4 has a base plate 5. A side plate 6 is formed by upwardly turning the periphery of the base plate 5. A rolled-in ring 7 is outwardly turned at the upper edge of the side plate 6. Pressed concave portions 8 and 8' are formed in the annular shape at the center portions of the top plate 2 of the main body 1 and the base plate 5 of the removable member 4 by cold pressure welding of the base plate 5 of the removable member 4 overlapped onto the top plate 2 of the cap main body 1. Thus, the cap main body 1 is integrally secured to the removable member 4 by such pressed concave portions 8 and 8' formed by the cold pressure welding. It is to be noted that the pressed concave portions 8 and 8' are formed thin. Expanded convex portions 5' and 2' of a generally spherical shape are formed within the annular pressed concave portions 8 and 8' of the base plate 5 and the top plate 2. The outer diameter of the rolled-in ring 7 is preferably the same as or slightly larger than the outer diamter of the side wall 3 of the cap main body 1.

Figure 2:
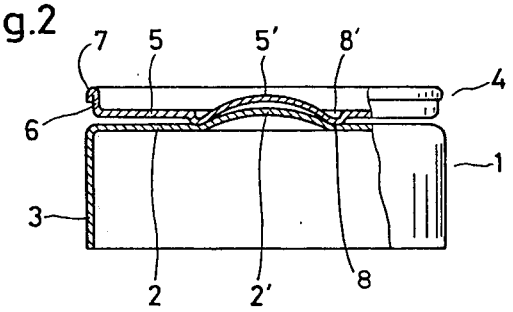
FIG. 2 is a front view with portions broken away of FIG. 1.
Figure 3:
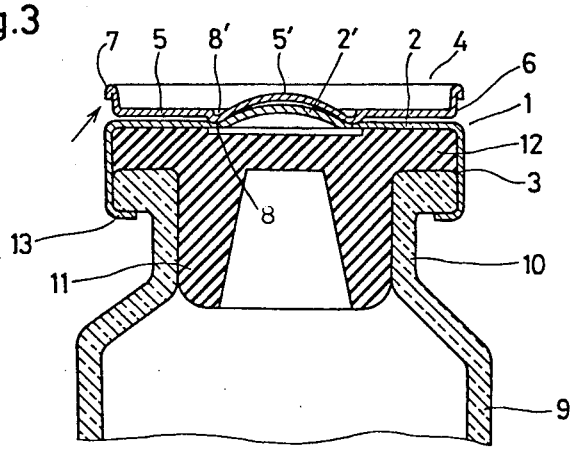
FIG. 3 is a section view showing a vial to which the cap in FIG. 2 is sealingly fitted.

A description now made of the cap shown in FIGS. 1 and 2 fitted to a vial, with reference to FIG. 3.

Mounted to the neck 10 of a vial 9 is a rubber stopper 12 having a cylindrical portion 11 press-fit to the inner wall of the neck 10. The cap main body 1 of a sterilized cap is then put on the rubber stopper 12 and the vial neck 10. The lower portion 13 of the side wall 3 of the cap main body 1 is rolled in to the lower surface of the vial neck 10 for preventing the rubber stopper 12 from coming up from the neck 10, as well as for sealingly fitting the cap to the neck 10 through the rubber stopper 12.

When opening the cap, the vial 9 is held with one hand and the rolled-in ring 7 is obliquely pushed up. The thin pressed concave portion 8 of the top plate 2 of the cap main body 1 is then broken, so that the expanded portion 2' of the top plate 2 is removed from the top plate 2, thereby to form a circular bore in the top plate 2.

Accordingly, with the thumb of the hand holding the vial to which the bottle cap according to the present invention is sealingly fitted, the periphery of the removable member 4 may be pushed up, and such pushing operation alone permits the predetermined portion of the top plate 2 of the cap main body 1 to be broken away, thus realizing a one-handed removal of the removable portion thereby to facilitate the cap opening operation to a great extent.

Since the cap main body 1 and the removable member 4 may be formed by stamping and securely fixed to each other by cold pressure welding, a good airtightness may be provided to prevent the entrance of bacteria and also the manufacturing may easily be done.

Furthermore, since the cap main body 1 and the removable member 4 are made of the same metallic material, such as aluminium, they may readily be fixed to each other by cold pressure welding and be sterilized, for example by heating, just before being fitted to a bottle after having been delivered from the factory, thereby to simplify sterilizing equipment and to facilitate the sterilizing procedures.

In addition, since the upwardly expanded portions 2' and 5' are formed within the annular concave portions 8 of the cap main body 1 and the removable member 4, it is possible to absorb expansion of the rubber stopper 12 due to the internal pressure in the bottle.

Moreover, since the rolled-in ring 7 is formed at the peripheral edge of the removable member 4, the periphery of the removable member 4 may be reinforced and such rolled-in ring 7 may also serve as contact portion for the finger at the time of the cap opening operation, thereby to facilitate the opening procedures.

Although, in the embodiment discussed hereinbefore, the side plate 6 of the removable member 4 has been formed by upwardly turning the peripheral edge of the base plate 5, such side plate may also be formed by downwardly turning the peripheral edge of the base plate 5 so as to form a rolled-in ring by outwardly turning the lower edge of the side plate and to be press-contacted to the side wall 3 of the cap main body 1. Such press-contact serves to prevent the entrance of dust or dirt into the clearance between the top plate 2 of the cap main body 1 and the base plate 5 of the removable member 4.

It is to be noted that, when the cap main body 1 and the removable member 4 are made of Alumite, the stability of the press-welding by the cold pressure welding may be improved.

Figure 4:
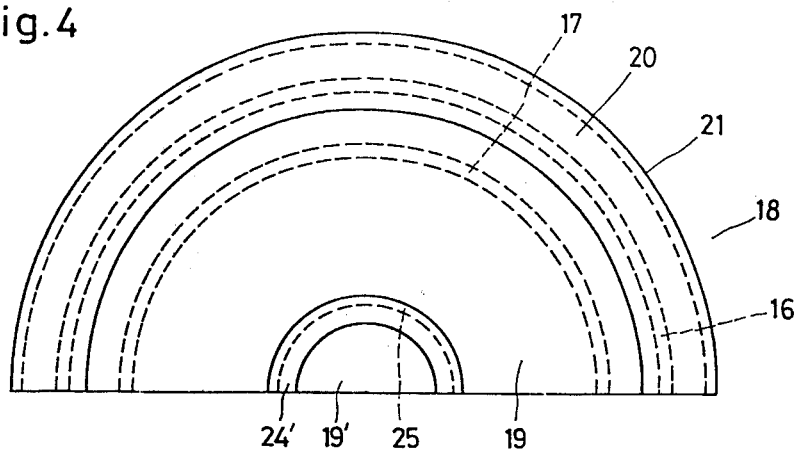
FIG. 4 is a plan view of main portions of a second embodiment of a bottle cap according to the present invention.
Figure 5:
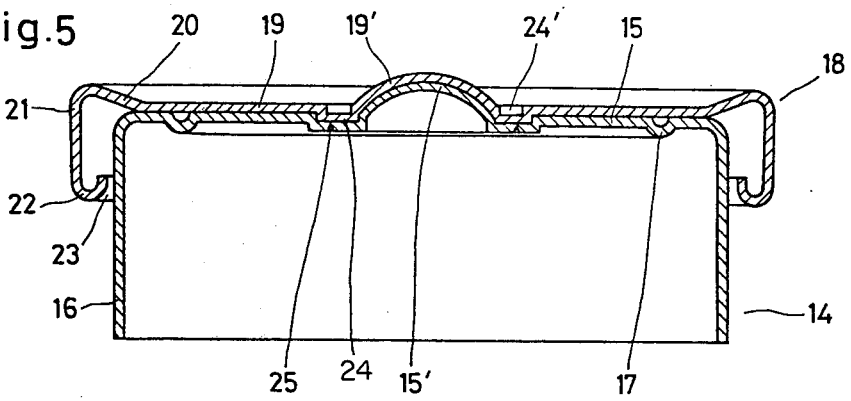
FIG. 5 is a vertical section view of FIG. 4.

The description will then be made of a second embodiment of the present invention with reference to FIGS. 4 and 5.

A cap main body 14 is made of metallic material such as aluminium. This cap main body 14 has a top plate 15 of a circular shape. A cylindrical side wall 16 is formed by downwardly turning the peripheral edge of the top plate 15. An annular projection 17 is formed at the under surface of the top plate 15 near the peripheral edge thereof. A removable member 18 is made of the same metallic material, such as aluminium, as material of the cap main body 14. A circular base plate 19 of the removable member 18 has an inclined portion 20, which is formed by upwardly turning the peripheral edge of the base plate 19 on a slant. A side plate 21 is formed by downwardly turning the peripheral edge of the inclined portion 20. A rolled-in ring 22 is formed by inwardly turning the lower edge of the side plate 21. There is disposed a clearance 23 between the rolled-in ring 22 and the side wall 16 of the cap main body 14. Pressed concave portions 24 and 24' for the fixing purpose are formed in the annular shape at the center portions of the top plate 15 and the base plate 19 by cold pressure welding of the base plate 19 of the removable member 18 overlapped to the top plate 15 of the cap main body 14. By these pressed concave portions 24 and 24', the cap main body 14 is securely fixed to the removable member 18. Expanded convex portions 15' and 19' of a generally spherical shape are formed within these annular pressed concave portions 24 and 24' of the top plate 15 and the base plate 19'.

Scores 25 of an annular shape are formed in the under surface of the pressed concave portion 24 of the top plate 15 at the positions near the peripheral edge thereof, and such scores 25 are formed at the same time of forming the pressed concave portions 24 and 24' formed by cold pressure welding.

Figure 6:
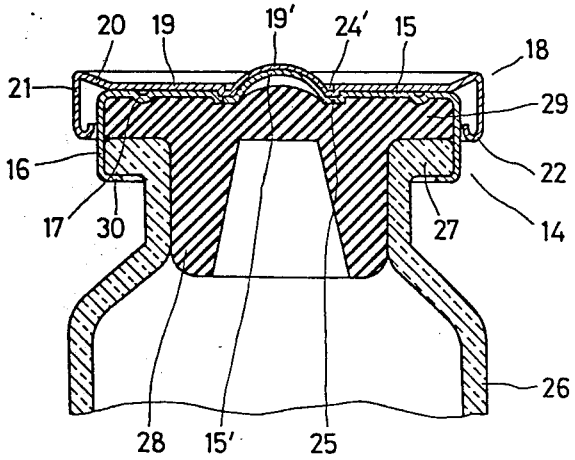
FIG. 6 is a section view showing a vial to which the cap in FIG. 5 is sealingly fitted.

A description is now made of the cap shown in FIGS. 4 and 5 fitted to a vial, with reference to FIG. 6.

Mounted to the neck 27 of a vial 26 is a rubber stopper 29 having a cylindrical portion 28 which is press-fit to the inner wall of the neck 27. The cap main body 14, which is sterilized is fitted to the rubber stopper 29 and the neck 27. The lower end 30 of the side wall 16 of the cap main body 14 is rolled in to the bottle neck 27, thereby to prevent the rubber stopper 29 from coming up from the bottle neck 27, as well as to sealingly fit the cap to the bottle neck 27 through the rubber stopper 29.

When opening the cap, the vial 26 is held with one hand and the rolled-in ring 22 of the removable member 18 is obliquely pushed up. The center portion of the top plate 15 is then pushed up together with the base plate 19 and the scores 25 are broken, so that the center portion of the top plate 15 is removed from the top plate 15, thereby to form a circular bore in the top plate 15.

Accordingly, the second embodiment shown in FIGS. 4 and 5 may provide other effects in addition to those provided in the first embodiment shown in FIGS. 1 and 2. Since the scores 25 are formed in the under surface of the pressed concave portion 24 of the top plate 15 of the cap main body 14, namely since the scores 25 are formed in the under surface of the pressed concave portion 24 to which a cap opening force is directly applied, cap opening procedures may be easily performed with a small and constant force alone.

Moreover, the scores 25 may be formed simultaneously with forming the pressed concave portion 24 thereby to facilitate the manufacturing of the cap to a great extent.

Furthermore, since the annular projection 17 is formed at the under surface of the top plate 15 of the cap main body 14, this annular projection 17 is fittingly pressed to the upper surface of the rubber stopper 29, so that the top plate 15 perfectly comes in close contact with the rubber stopper 29, thereby to prevent dust or bacteria from entering the scores 25 from the clearance between the top plate 15 and the rubber stopper 29.

What is claimed is:

1. A bottle cap comprising;

a cap main body having a circular top plate and a side wall downwardly depending from the peripheral edge of said top plate and adapted to be rolled in toward the outer surface of the neck of a bottle, a removable member having a circular base plate and a peripheral edge thereof to which a removing force is to be applied, said cap main body and said removable member being of metallic material, said base plate of said removable member being overlapped onto said top plate of said cap main body, said top plate of said cap main body and said base plate of said removable member being securely fixed to each other by cold pressure welding forming pressed concave portions of annular shape in said top plate and said base plate, and upwardly expanded portions formed within said pressed concave portions of said top plate and said base plate.

2. A bottle cap as in claim 1, wherein said pressed concave portions are formed thin so that, by upwardly pushing the periphery of said removable member when opening said cap, said pressed concave portion of said top plate of said cap main body is broken, whereby said expanded portion of said top plate is removed from said top plate.

3. A bottle cap as in claim 1, wherein annular scores are formed in the under surface of said pressed concave portion of said top plate of said cap main body, so that, by upwardly pushing the periphery of said removable member when opening said cap, said scores are broken whereby said expanded portion of said top plate is removed from said top plate.

4. A bottle cap as in claim 1, wherein an annular projection is formed on the under surface of said top plate of said cap main body outside of said pressed concave portion thereof, said annular projection adapted to be press-contacted to the upper surface of the rubber stopper press-fit into the neck of a bottle.

5. A bottle cap as in claim 1, wherein a rolled-in ring is formed at the peripheral edge of said removable member.

6. A bottle cap as in claim 1 wherein the metal of both the cap main body and the removable member is aluminum.

7. A bottle cap as in claim 1 wherein said peripheral edge of said removable member extends upwardly away from said top plate of said cap main body.

8. A bottle cap as in claim 1 wherein said peripheral edge of said removable member extends downwardly to overlie at least a part of the peripheral edge of said top plate of said cap main body.

* * * * *